US006663379B2

(12) United States Patent
Carroni et al.

(10) Patent No.: US 6,663,379 B2
(45) Date of Patent: Dec. 16, 2003

(54) CATALYZER

(75) Inventors: Richard Carroni, Niederrohrdorf (CH); Timothy Griffin, Ennetbaden (CH); Verena Schmidt, Baden (CH)

(73) Assignee: Alstom (Switzerland) Ltd, Baden (CH)

( * ) Notice: Subject to any disclaimer, the term of this patent is extended or adjusted under 35 U.S.C. 154(b) by 0 days.

(21) Appl. No.: 10/134,590

(22) Filed: Apr. 30, 2002

(65) Prior Publication Data

US 2002/0182551 A1 Dec. 5, 2002

Related U.S. Application Data

(60) Provisional application No. 60/286,993, filed on Apr. 30, 2001.

(30) Foreign Application Priority Data

Dec. 14, 2001 (CH) ..... 2300/01

(51) Int. Cl.[7] ..... F23D 3/40; F23M 3/00

(52) U.S. Cl. ..... 431/7; 431/170; 431/268; 431/326; 431/9

(58) Field of Search ..... 431/7, 9, 170, 431/268, 326

(56) References Cited

U.S. PATENT DOCUMENTS 5,162,288 A * 11/1992 Stringaro ..... 502/439
5,202,303 A 4/1993 Retallick et al.
5,250,489 A * 10/1993 Dalla Betta et al. ..... 502/262
5,328,359 A 7/1994 Retallick
5,346,389 A 9/1994 Retallick et al.
5,437,099 A 8/1995 Retallick et al.
5,460,002 A 10/1995 Correa
5,476,375 A * 12/1995 Khinkis et al. ..... 431/7
5,514,347 A 5/1996 Ohashi et al.
5,518,697 A * 5/1996 Dalla Betta et al. ..... 422/173
6,179,608 B1 1/2001 Kraemer et al.
2002/0155403 A1 * 10/2002 Griffin et al. ..... 431/7

FOREIGN PATENT DOCUMENTS

EP 0 433 223 A1 6/1991
WO 93/25852 12/1999

OTHER PUBLICATIONS

Richard Carroni et al., U.S. patent application No. 10/134,595 entitled "*Catalyzer*" filed Apr. 30, 2002.

* cited by examiner

*Primary Examiner*—Alfred Basichas
(74) *Attorney, Agent, or Firm*—Burns, Doane, Swecker & Mathis, L.L.P.

(57) ABSTRACT

The invention relates to a catalyzer for burning at least part of a fuel/oxidant mixture flowing through the catalyzer, in particular for a burner of a power plant installation. The catalyzer comprises several catalytically active channels and several catalytically inactive channels. A longitudinal section of the catalyzer is spaced apart from an inflow side in the main flow direction. In this longitudinal section turbulators are arranged in at least several catalytically active channels. In addition or alternatively, connections that enable a flow between the channels are formed in this longitudinal section between several adjoining channels.

15 Claims, 2 Drawing Sheets

CATALYZER

This application claims priority under 35 U.S.C. §§119 and/or 365 to 2001 2300/01 filed in Switzerland on Dec. 14, 2001, and to U.S. Provisional Application No. 60/286,993, entitled "Design of Catalytic Combustor to Increase Conversion" filed on Apr. 30, 2001, the entire contents of both applications are hereby incorporated by reference.

FIELD OF THE INVENTION

The invention relates to a catalyzer for burning at least part of a fuel/oxidant mixture flowing through the catalyzer.

BACKGROUND OF THE INVENTION

U.S. Pat. No. 5,346,389, U.S. Pat. No. 5,202,303, U.S. Pat. No. 5,437,099, and U.S. Pat. No. 5,328,359 disclose catalyzers of an initial type, each of which comprises several catalytically active channels and several catalytically inactive channels. The known catalyzers are produced using zigzag-shaped corrugated or folded sheets that are layered by way of a helical winding or by folding back and forth. The corrugations or folds then form the channels of the catalyzer. One side of the respective sheet is constructed catalytically active by way of a catalyzer coating. In this way, the layering or stacking creates the catalytically active channels and the catalytically inactive channels. The conversion or combustion of the fuel/oxidant mixture takes place inside the coated or catalytically active channels. In essence, no conversion or combustion of the mixture takes place in the uncoated or catalytically inactive channels, so that this part of the mixture flow can be used for removing heat, i.e. for the cooling of the catalyzer.

Because of the one-sided coating with catalyzer material and a corresponding stacking or layering of the sheets used to construct the catalyzer, a catalyzer construction can be achieved, in which approximately half of all channels are completely catalytically coated, while the other half of the channels are uncoated. In this embodiment, the temperature increase in the catalyzer can be effectively reduced since the combustion of the mixture in the catalyzer is limited to the catalytically active channels and therefore to approximately 50%. This construction makes it possible to prevent an overheating of the catalyzer that could result in its destruction.

U.S. Pat. No. 4,154,568 discloses a catalyzer of a principally different construction with several monolith blocks arranged consecutively in the main flow direction. The monolith blocks contain channels that are all catalytically active and extend parallel to the main flow direction. The channels of a monolith block located downstream have a smaller flow cross-section than those of the monolith block located upstream. This is meant to achieve a complete combustion of the fuel/oxidant mixture inside the catalyst, while in the catalyzers of this class, only part of the gas mixture is supposed to be burned.

In the catalyzers of the initially mentioned type, the catalytically active channels and the catalytically inactive channels result in a reduction of the fuel conversion, and thus in a reduction of the operating temperature of the catalyzer, so that sufficiently long lives can be achieved for said catalyzer. In a construction with 50% catalytically active channels and 50% catalytically inactive channels, the maximum achievable degree of conversion of the fuel is reduced to 50%. This also has the result that the fuel concentration at the catalyzer outlet over the cross-section is subject to high fluctuations. While almost no fuel exits from the catalytically active channels then, the almost unchanged fuel/oxidant mixture flows from the catalytically inactive channels. If an ignition of the mixture occurs before it mixes downstream from the catalyzer, the subsequent combustion reaction may result in temperature peaks in the catalyzer that are associated with the production of harmful substances, in particular NOX.

Another problem is that the conversion of the fuel inside the catalytically active channels only achieves the desired degree of conversion if a sufficiently long channel length exists. This is attributed to the fact that, on the one hand, the fuel content decreases in flow direction, and, on the other hand, the thickness of the boundary layer increases. In order to achieve a high degree of conversion, a conventional catalyzer therefore is relatively long in the main flow direction, which is associated with relatively high-pressure losses.

SUMMARY OF THE INVENTION

The invention means to remedy this. The invention is concerned with disclosing an improved embodiment, in particular with a compact construction, for a catalyzer of the initially mentioned type.

In an exemplary embodiment, a catalyzer for burning at least part of a fuel/oxidant mixture flowing through the catalyzer has several catalytically active channels and several catalytically inactive channels. In a longitudinal section of the catalyzer spaced apart from the inflow side of the catalyzer in the main flow direction, one or more from the group of turbulators are arranged in at least several catalytically active channels and connections are formed at least between several catalytically active channels and catalytically inactive channels enabling a flow between catalytically active channels and catalytically inactive channels.

In an exemplary embodiment, a catalyzer for burning at least a part of a fuel/oxidant mixture flowing through the catalyzer has a plurality of catalytically active channels and a plurality of catalytically inactive channels, and one or more from the group of a plurality of turbulators and a plurality of connections. Each channel has a first longitudinal portion upstream in a main flow direction of a second longitudinal portion. The plurality of turbulators are arranged in the second longitudinal portion of at least several of the catalytically active channels and the plurality of connections are formed in the second longitudinal portion between at least several catalytically active channels and catalytically inactive channels to operatively exchange a gas between the catalytically active channels and the catalytically inactive channels.

BRIEF DESCRIPTION OF THE DRAWINGS

A preferred embodiment of the invention is disclosed in the following description and illustrated in the accompany drawing in which.

DETAILED DESCRIPTION OF THE INVENTION

Channels in a longitudinal section are spaced away from an inflow side of the catalyzer in such a way that the turbulence is increased at least inside the catalytically active channels and/or that an exchange of matter or gas is possible between adjoining catalytically active and catalytically inactive channels. The conversion of the fuel is improved by increasing the turbulence, so that the catalyzer can be constructed shorter in the main flow direction. The mixing possibility permits an increase in the degree of conversion, or the desired degree of conversion can already be achieved with a shorter catalyzer length.

The invention utilizes the finding that a relatively high degree of conversion is achieved in the catalytically active channels even after a relatively short flow distance, after which it only increases relatively slowly over the remaining length of the respective catalytic channel. For example, measurements found that after approximately 13% of the total length of a conventional catalyzer already approximately 50% of the fuel had been converted in the respective catalytically active channel. The invention utilizes this finding by intensifying the conversion after this frontal longitudinal section, which is very effective with respect to the conversion, by using turbulators in the channels and/or by way of cross-connections between adjoining channels in this following longitudinal section. This makes it possible for the catalyzer according to the invention to be constructed overall shorter.

In a preferred embodiment, the connections, which enable a flow between the catalytically active and catalytically inactive channels between adjoining channels, are formed by holes that extend through the channel walls of adjoining channels, transversely to the main flow direction of the catalyzer, whereby these holes are punched into the channel walls in such a way that a wall section associated with the respective hole remains connected with the channel wall and projects into one of the channels. In this embodiment, the remaining wall sections form turbulators for a targeted guidance of the flow. This embodiment can be produced especially simply.

Figure 1:
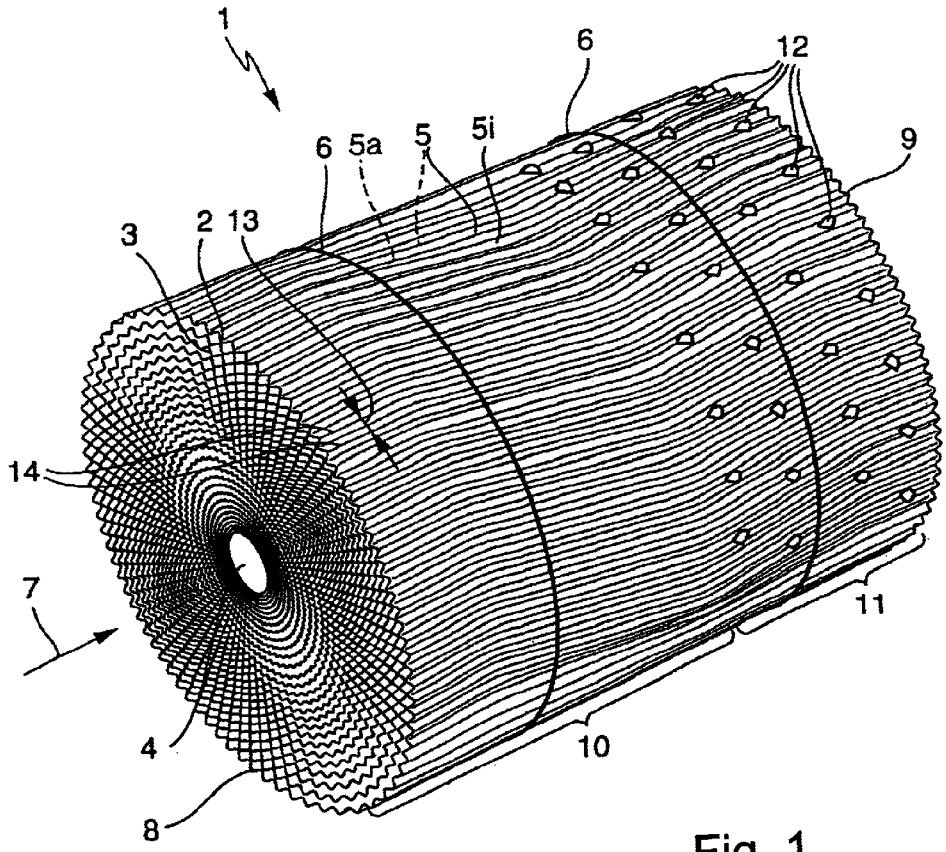
FIG. 1 shows a perspective view of a preferred embodiment of the catalyzer according to the invention.

According to FIG. 1, an exemplary embodiment of catalyzer 1 according to the invention may have, for example, a cylindrical construction. Such a catalyzer 1 is produced, for example, in that onto a first web material 2, which is corrugated or folded in a predetermined manner, a second web material 3 is placed, which also may be corrugated or folded with a specific pattern. The two patterns for folding or corrugating the web materials 2 and 3 are hereby adapted to each other in such a way that, when the web materials 2 and 3 are placed on top of each other, the individual folds or corrugations cannot mesh with each other but support themselves on each other by way of their high points. The second web material 3 also can be constructed in a smooth or flat manner.

It is useful that the web materials 2 and 3 consist of a metal sheet, whereby at least one of the web materials 2 and 3 may be provided on one side with a catalytically active coating. If both web materials 2 and 3 are provided on one side with a catalyzer layer, the two web materials 2 and 3 are placed on top of each other in such a way that the coated sides face each other or face away from each other. The two web materials 2 and 3 are then wound helically onto a central spindle 4, which results in a radial layering or stacking of the web materials 2 and 3. The corrugations or folds of the web materials 2,3 extend essentially parallel to the spindle 4 and, in the rolled-up state, form channels 5, of which some are catalytically active (catalytically active channels 5*a*), while the others are catalytically inactive (catalytically inactive channels 5*i*). Because of the one-sided coating of the web materials 2,3, approximately half of the channels 5 are catalytically active, while the other half is catalytically inactive. The shape of the winding of the web materials 2 and 3 is fixed with the help of tension wires 6.

In a preferred embodiment, the catalyzer 1 can be inserted into a burner, whereby a fuel/oxidant mixture then is able to flow through the catalyzer 1 in a main flow direction 7 symbolized by an arrow. The main flow direction 7 extends parallel to the longitudinal axis of the spindle 4 and therefore parallel to the longitudinal axis of the cylindrical catalyzer 1. A catalytic burner formed in this manner also may be positioned before a combustion chamber that is used to generate hot gases for a turbine, in particular a gas turbine, of a power plant installation.

In relation to the main flow direction 7, the catalyzer 1 has an inflow side 8 and an outflow side 9. A longitudinal section 10 extending in the main flow direction 7 and comprising the inflow side 8 is characterized by a brace and is called the inlet section 10 from hereon. The catalyzer 1 also has a longitudinal section 11, also designated with a brace, which extends parallel to the main flow direction 7 and is spaced apart from the inflow side 8. Since this longitudinal section 11 spaced apart from the inflow side 8 comprises the outflow side 9 in the exemplary embodiment shown here, this longitudinal section 11 is also called the outlet section 11 from hereon. In the exemplary embodiment shown here, the outlet section 11 only starts in the second half of the catalyzer 1 with respect to the overall length of the catalyzer 1. The outlet section 9 hereby can be constructed shorter in the main flow direction 7 than the inlet section 10. It is also possible that the outlet section 11 has a greater axial extension than the inlet section 10.

According to the invention, connections 12, through which the adjoining channels 5 communicate with each other, are formed in the outlet section 11. These connections 12 therefore permit a flow-through, and thus an exchange of gas or matter, between catalytically active channels 5*a* and catalytically inactive channels 5*i*. These connections 12 here are formed by holes that are integrated into the channel walls, i.e. into the corrugations or folds of the web materials 2,3. These holes 12 hereby extend through the channel walls transversely to the main flow direction 7. The holes 12 hereby can be arranged so that a flow takes place between the channels 5 that are arranged so as to adjoin each other in the circumferential direction of the cylindrical catalyzer 1 and/or in radial direction relative to each other.

In the web material 2 or 3, a distance 13 measured transversely to the main flow direction 7 or in the circumferential direction of the catalyzer 1 and existing between two high points 14 or, correspondingly, between two low points of adjoining corrugations or folds, forms a corrugation length or fold length of the web material 2 or 3. This corrugation or fold length 13 forms a base measure for the size and position of the holes 12. It is useful that, transversely to the longitudinal channel direction, i.e. in circumferential direction or radial direction of the cylinder 1, the holes 12 have a transverse dimension that is smaller than the corrugation or fold length 13. The transverse dimension of the holes 12 is preferably smaller than half of the corrugation or fold length 13. A distance between adjoining holes 12 is in a specific direction, for example in the longitudinal channel direction and/or transversely to it, greater than the hole diameter in this direction and/or greater than the corrugation or fold length 13. The holes 12 preferably have a circular or elliptical base shape. In principle, any desired shape is possible for the holes, however.

Figure 2:
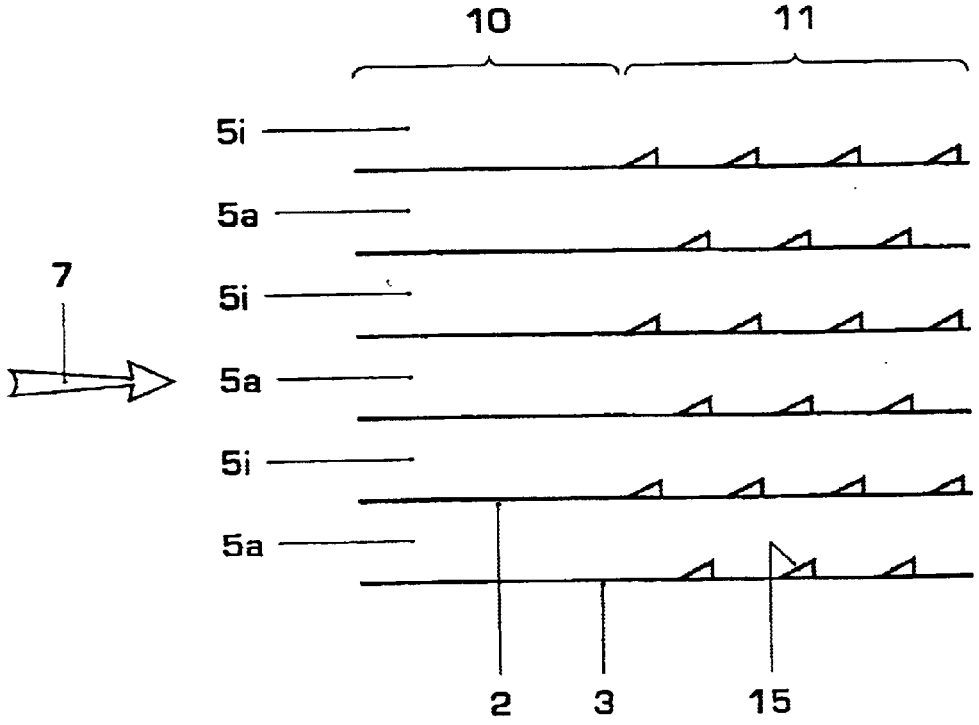
FIG. 2 shows a schematic cross-section of a preferred embodiment of a catalyzer.

In a preferred embodiment, the holes 12 can be punched into the channel walls, i.e. into the web materials 2,3. This punching process is hereby performed in such a way that a wall section associated with the respective hole 12 remains connected with the channel wall, i.e. the respective web material 2,3, and is bent to such an extent that it projects into one of the channels 5. This wall section not visible in the figure hereby forms a flow-conducting element in the respective channel 5 and may serve in particular as a turbulator. In addition or alternatively to these wall sections, turbulators that generate transverse flows inside the respective channels 5 can be arranged in at least some of the catalytically active channels 5*a*. Such turbulators can be formed by projections that project into the respective channel 5. Such projections can be formed, for example, in that the web materials 2 have inside their corrugation or fold length 13 one or more additional corrugations or folds that project into the respective channel 5. It is also possible to form turbulators in the form of a perforation of the channel walls or web materials 2,3, for example by making relatively small openings with a pointed object, whereby material protuberances are created at the edge of the opening. These openings hereby can be so small that no appreciable gas exchange between adjoining channels 5 occurs through them. It is however useful that this type of perforation is realized so no holes 12 need to be made in this section. Another measure for achieving the desired turbulator function is to provide the channel walls or web materials 2,3 in the corresponding section with a surface roughness suitable for this purpose. The catalyzer material, for example, can be applied in a corresponding manner so that the required surface roughness is formed through the coating with the catalyzer material. FIG. 2 shows a schematic crosssection of a preferred embodiment of a catalyzer having turbulators, projections, protuberances and/or surface roughness 15 in the outlet section 11. The turbulators, projections, protuberances and/or surface roughness 15 are present in both catalytically active channels 5*a* and catalytically inactive channels 5*i*.

In the preferred embodiment shown here, the catalyzer 1 is formed in one piece with its inlet section 10 and its outlet section 11, creating a unit that can be produced in a simple manner and at low cost. It is also possible to produce the inlet section 10 and the outlet section 11 separately from each other, whereby the catalyzer 1 is then assembled from these individual parts (inlet section 10 and outlet section 11), in order to again obtain a unit that can be easily handled.

The catalyzer 1, in an exemplary embodiment, functions as follows:

During operation, the catalyzer 1 receives on its inflow side 8 a fuel/oxidant mixture that penetrates into the channels 5 of the catalyzer 1. The conversion of the fuel starts in the catalytically active channels 5*a*. The heat released hereby is removed at least in part by way of the flow present in the catalytically inactive channels 5*i*. After a relatively short flow distance, the conversion of the fuel has already progressed relatively far. It is useful that the outlet section 11 is positioned so that it starts at approximately the point where approximately 50% to 80% of the fuel transported in the catalytically active channels 5*a* has been converted. The flows of the catalytically active channels 5*a* and of the catalytically inactive channels 5*i* are then mixed intensively in the outlet section 11. At the same time, the transverse flows improve the conversion behavior, so that the degree of conversion of the entire supplied fuel/oxidant mixture can be additionally improved inside the outlet section 11 over a relatively short flow distance. The construction according to the invention therefore makes it possible to achieve relatively high degrees of conversion in a catalyzer 1 with a relatively short construction in the main flow direction 7, in particular of more than 50% of the total mixture. Because of the short construction length of the catalyzer 1, the pressure loss simultaneously is reduced during the flow through the catalyzer 1, which is particularly advantageous for the combustion processes taking place downstream from the catalyzer 1.

What is claimed is:

1. A catalyzer for burning at least part of a fuel/oxidant mixture flowing through the catalyzer, the catalyzer comprising:

several catalytically active channels; and several catalytically inactive channels;

wherein, only in a longitudinal section of the catalyzer spaced apart from an inflow side of the catalyzer in a main flow direction of the catalyzer, the catalyzer includes one or more of the group of: turbulators arranged in at least several catalytically active channels and connections formed at least between several catalytically active channels and catalytically inactive channels, said connections enabling a flow between catalytically active channels and catalytically inactive channels.

2. The catalyzer according to claim 1, wherein the turbulators include one or more from the group of: a projection projecting into the respective channel, a perforation, a protuberance, and a corresponding surface roughness.

3. The catalyzer according to claim 1, wherein the connections are formed by holes that extend through the channel walls of adjoining channels transversely to the main flow direction of the catalyzer.

4. The catalyzer according to claim 3, wherein the holes are punched into the channel walls, whereby a wall section associated with the respective hole remains connected with the channel wall and projects into one of the channels.

5. The catalyzer according to claim 3, wherein the catalyzer is formed by stacking or layering zigzag-shaped corrugated or folded web material, whereby the corrugations or folds of the web material form the channels, whereby a distance measured transversely to a longitudinal direction of the channels forms a corrugation length or fold length between a high point or low point of adjoining corrugations or folds, whereby the holes, transverse to the longitudinal channel direction, have a transverse dimension that is smaller than an overall length, or half corrugation or fold length.

6. The catalyzer according to claim 5, wherein one or more of the group of a distance of adjoining holes transverse to the longitudinal channel direction and a distance of adjoining holes in the longitudinal direction of the channel is greater than one or more of the group of: the hole diameter in said direction, the corrugation length and the fold length.

7. The catalyzer according to claim 5, wherein the corrugated or folded web material is radially layered or stacked in relation to a central spindle oriented parallel to the main flow direction of the catalyzer and is arranged helically or in concentric circles.

8. The catalyzer according to claim 7, wherein a layer of flat or smooth web material is arranged in a radial direction between two layers of the corrugated or folded web material.

9. The catalyzer according to claim 1, wherein the longitudinal section provided with one or more of the group of the connections and turbulators starts at a longitudinal distance from the inflow side, at which a fuel is at least 50% converted inside the catalytically active channels during normal operation of the catalyzer.

10. The catalyzer according to claim 1, wherein the catalyzer is formed in one piece with the longitudinal section comprising one or more of the group of the connections and the turbulators and with a second longitudinal section comprising the inflow side.

11. The catalyzer according to claim 1, wherein the longitudinal section comprising one or more of the group of the connections and the turbulators and a second longitudinal section comprising the inflow side are constructed as separate bodies, from which the catalyzer is assembled.

12. The catalyzer of claim 9, wherein at least 75% of the fuel is converted inside the active channels during normal operation of the catalyzer.

13. The catalyzer of claim 12, wherein at least 80% of the fuel is converted inside the active channels during normal operation of the catalyzer.

14. The catalyzer of claim 1, wherein the catalyzer is for a burner of a power plant installation.

15. A catalyzer for burning at least a part of a fuel/oxidant mixture flowing through the catalyzer, the catalyzer comprising:

a plurality of catalytically active channels and a plurality of catalytically inactive channels, each channel having a first longitudinal portion upstream in a main flow direction of a second longitudinal portion; and one or more from the group of a plurality of turbulators and a plurality of connections, wherein the plurality of turbulators are arranged only in the second longitudinal portion of at least several of the catalytically active channels and the plurality of connections are formed in the second longitudinal portion between at least several catalytically active channels and catalytically inactive channels to operatively exchange a gas between the catalytically active channels and the catalytically inactive channels.

* * * * *